US009967675B2

(12) United States Patent
Calmel et al.

(10) Patent No.: US 9,967,675 B2
(45) Date of Patent: May 8, 2018

(54) COMPACT ELECTRODYNAMIC LOUDSPEAKER HAVING A CONVEX DIAPHRAGM

(71) Applicant: DEVIALET, Paris (FR)

(72) Inventors: Pierre-Emmanuel Calmel, Le Chesnay (FR); Antoine Petroff, Paris (FR); Jean-Loup Afresne, Paris (FR)

(73) Assignee: DEVIALET, Paris (FR)

( * ) Notice: Subject to any disclaimer, the term of this patent is extended or adjusted under 35 U.S.C. 154(b) by 22 days.

(21) Appl. No.: 15/101,398

(22) PCT Filed: Dec. 5, 2014

(86) PCT No.: PCT/EP2014/076674
§ 371 (c)(1),
(2) Date: Oct. 7, 2016

(87) PCT Pub. No.: WO2015/082668
PCT Pub. Date: Jun. 11, 2015

(65) Prior Publication Data

US 2017/0171663 A1 Jun. 15, 2017

(30) Foreign Application Priority Data

Dec. 5, 2013 (FR) ..... 13 62211

(51) Int. Cl.
*H04R 9/06* (2006.01)
*H04R 9/02* (2006.01)
(Continued)

(52) U.S. Cl.
CPC ..... *H04R 9/06* (2013.01); *H04R 7/127* (2013.01); *H04R 7/18* (2013.01); *H04R 9/025* (2013.01);
(Continued)

(58) Field of Classification Search
CPC . H04R 7/127; H04R 7/16–7/20; H04R 9/041; H04R 9/043; H04R 9/045;
(Continued)

(56) References Cited

U.S. PATENT DOCUMENTS 3,925,626 A * 12/1975 Stallings, Jr. ..... H04R 1/021 181/153
4,158,756 A * 6/1979 Keezer ..... H04R 7/12 29/594
(Continued)

FOREIGN PATENT DOCUMENTS

EP 0 680 242 A1 11/1995
EP 2 026 600 A1 2/2009
WO WO 2010/016898 A1 2/2010

OTHER PUBLICATIONS

Preliminary Search Report dated Jul. 11, 2014 in related French Patent Application No. 13 62211.
(Continued)

*Primary Examiner* — Joshua Kaufman
(74) *Attorney, Agent, or Firm* — Eric L. Lane; Green Patent Law

(57) ABSTRACT

An electrodynamic loudspeaker (10) including:
a chassis (15),
at least one magnetic circuit (20) secured to the chassis,
at least one movable assembly (30) with respect to the chassis, the assembly (30) including a convex diaphragm (53) turned towards the outside of the loudspeaker, and at least one energizing coil (57) defining an axis (D) of the loudspeaker,
a first suspension joint (35) connecting the assembly and the chassis, and
a second suspension joint (40) of the assembly, the second joint being axially further away from the diaphragm than the first joint.
(Continued)

The assembly further comprises at least one connecting member (59) secured to the diaphragm, the second joint including a radially inner attachment point (81) attached on the connecting member, and a radially outer attachment point (83) attached on the chassis.

9 Claims, 1 Drawing Sheet

(51) Int. Cl.
*H04R 7/18* (2006.01)
*H04R 7/12* (2006.01)

(52) U.S. Cl.
CPC .. *H04R 2207/021* (2013.01); *H04R 2231/003* (2013.01)

(58) Field of Classification Search
CPC ..... H04R 2207/021; H04R 2231/003; H04R 2307/021
See application file for complete search history.

(56) References Cited

U.S. PATENT DOCUMENTS 4,190,746 A * 2/1980 Harwood ..... H04R 7/02 181/167
4,295,006 A * 10/1981 Tanaka ..... H04R 1/24 381/99
4,387,275 A * 6/1983 Shimada ..... H04R 1/225 181/166
4,477,699 A * 10/1984 Wada ..... H04R 7/122 181/144
4,517,416 A * 5/1985 Goossens ..... H04R 7/02 181/144
4,567,327 A * 1/1986 Goossens ..... H04R 7/04 181/173
5,664,024 A * 9/1997 Furuta ..... H04R 7/127 381/396
5,933,512 A * 8/1999 Tamura ..... H04R 9/06 381/186
6,496,590 B2 * 12/2002 Proni ..... H04R 9/06 381/423
6,672,423 B2 * 1/2004 Kato ..... H04R 9/043 181/154
6,862,361 B2 * 3/2005 James ..... H04R 7/20 181/171
7,197,154 B2 * 3/2007 Sahyoun ..... H04R 7/12 381/403
7,225,895 B2 * 6/2007 Sahyoun ..... H04R 7/20 181/147
8,204,269 B2 * 6/2012 Sahyoun ..... H04R 9/043 381/398
9,571,935 B2 * 2/2017 Moro ..... H04R 9/022
2002/0017423 A1 * 2/2002 Kato ..... H04R 9/043 181/161
2002/0146145 A1 * 10/2002 James ..... H04R 7/20 381/426
2005/0078849 A1 * 4/2005 Funahashi ..... H04R 31/006 381/412
2006/0274914 A1 * 12/2006 Horigome ..... H04R 1/22 381/424
2006/0285718 A1 * 12/2006 Funahashi ..... H04R 9/025 381/403
2010/0177925 A1 7/2010 Furuto et al.
2011/0075880 A1 * 3/2011 Kamimura ..... H04R 1/06 381/413
2011/0135111 A1 * 6/2011 Suzuki ..... H04R 7/20 381/86
2011/0232990 A1 * 9/2011 Kobayashi ..... H04R 7/16 181/157
2012/0195457 A1 * 8/2012 Shin ..... H04R 7/122 381/398
2015/0071481 A1 * 3/2015 Little ..... H04R 7/16 381/398

OTHER PUBLICATIONS

International Search Report dated Feb. 16, 2015 in related international Application No. PCT/EP2014/076674.

* cited by examiner

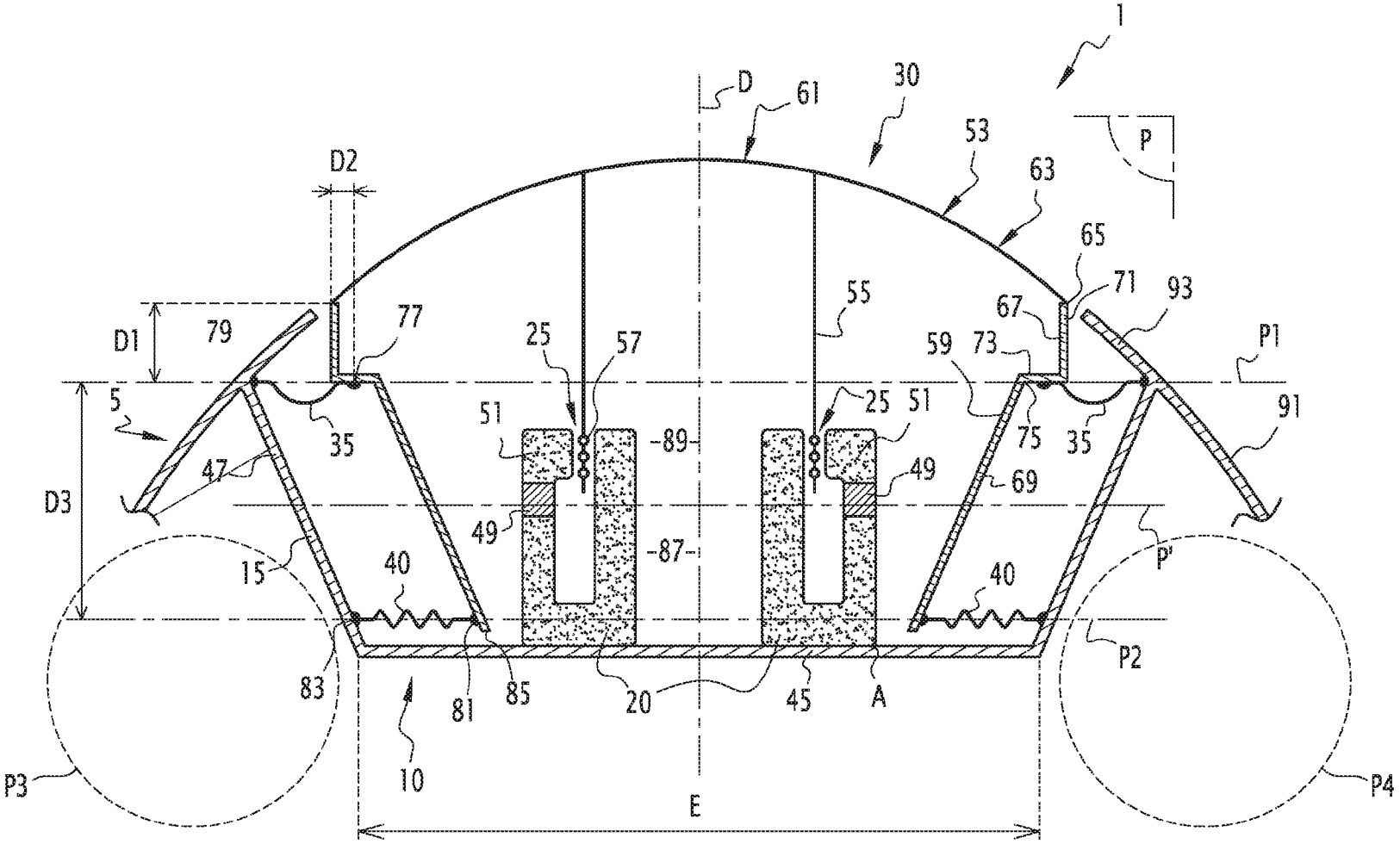
1
P
30
53
63
61
D
65
71
93
91
P1
P'
P2
P4
P3
35
67
73
75
69
59
40
51
49
25
55
A
45
20
E
89
87
57
85
81
10
77
D2
79
47
15
83
D1
5
D3

COMPACT ELECTRODYNAMIC LOUDSPEAKER HAVING A CONVEX DIAPHRAGM

BACKGROUND OF THE INVENTION

Field of the Invention

The present invention relates to an electrodynamic loudspeaker.

SUMMARY OF THE INVENTION

The present invention relates to an electrodynamic loudspeaker including:

- a chassis,
- at least one magnetic circuit secured to the chassis and defining at least an air gap,
- at least one mobile assembly with respect to the chassis, the assembly including a convex diaphragm, the convexity of which is turned towards the outside of the loudspeaker, and at least one coil for energizing the diaphragm, the coil being located in the air gap and defining an axis of the loudspeaker,
- a first suspension joint of the assembly connecting the assembly and the chassis, and
- a second suspension joint of the assembly, the second joint being axially further away from the diaphragm as the first joint.

DESCRIPTION OF RELATED ART

Conventionally, the first joint is attached on a coil-holder or on an edge of the diaphragm, in the front of the loudspeaker. The second joint is also attached on the coil-holder, generally just in front of the magnetic circuit. For reasons of mechanical stability of the mobile assembly, the first joint and the second joint are axially separated by a certain distance. The result of this is that the loudspeaker is radially not very extended around the magnetic circuit, but has a consequent axial extension, further increased by the convexity of the diaphragm.

In order to solve this problem, it is known how to bring closer axially the diaphragm and the magnetic circuit so that the edge of the diaphragm is radially located facing the magnetic circuit. The second joint includes a radially inner attachment point attached on the magnetic circuit, and a radially outer attachment point attached on the edge of the diaphragm. Such a loudspeaker has good axial compactness.

However, because of the convexity of the diaphragm, the edge of the diaphragm is radially located at a certain distance from the magnetic circuit. Further, notably in the case of a bass loudspeaker, in operation, the diaphragm has a significant axial displacement. Thus, the chassis, which defines an inner space receiving at least partly the diaphragm at rest like in operation, has a significant radial extension at the magnetic circuit. Stated in other words, instead of having a thin yoke, the loudspeaker has a wide bottom. Such a loudspeaker may prove to be bulky and difficult to arrange in an acoustic chamber, notably if the latter is of a general substantially spherical shape in the vicinity of the diaphragm or if the chamber includes other contiguous loudspeakers angularly shifted with respect to said loudspeaker.

An object of the invention is therefore to provide a loudspeaker which is more easy to lay out, in particular in an acoustic chamber with a general substantially spherical shape in the vicinity of the diaphragm or including at least one other contiguous loudspeaker to said loudspeaker and angularly shifted relatively to it.

BRIEF SUMMARY

For this purpose, the object of the invention is a loudspeaker of the type described above, wherein the assembly further comprises at least one connecting member secured to the diaphragm, the second joint including a radially inner attachment point attached on the connecting member, and a radially outer attachment point attached on the chassis.

According to particular embodiments of the invention, the loudspeaker comprises one or several of the following features, taken individually or according to all the technically possible combinations:

- the coil occupies at rest a rest position located axially between a first radial plane in which the first joint substantially extends, and a second radial plane in which the second joint substantially extends;
- the rest position of the coil is located axially between the first radial plane and the middle plane located at an equal distance from the first plane and from the second plane;
- the assembly further comprises a coil-holder attached on a central portion of the diaphragm, the connecting member being distinct from the coil-holder and attached on a peripheral portion of the diaphragm, preferably on a peripheral edge of the diaphragm;
- the connecting member has a general shape which axially converges in the direction from the diaphragm to the magnetic circuit;
- the first joint includes a radially inner attachment point attached on the connecting member, the connecting member having a shape so that said radially inner attachment point of the first joint is axially located away from the peripheral edge of the diaphragm;
- said shape of the connecting member is such that said radially inner attachment point of the first joint is substantially closer to the axis than the peripheral edge of the diaphragm;
- the connecting member includes a proximal portion axially with respect to the diaphragm, and a distal portion axially relatively to the diaphragm, the radially inner attachment point of the second joint being substantially located along the axis on an end of the distal portion, the end being opposite to the proximal portion along the axis;
- the connecting member is openworked.

The invention also relates to an acoustic chamber including at least one loudspeaker as defined above.

BRIEF DESCRIPTION OF THE SEVERAL VIEWS OF THE DRAWINGS

The invention will be better understood upon reading the description which follows, only given as an example and made with reference to the appended drawings, wherein the single FIGURE, FIG. 1, is a schematic view of an acoustic chamber according to the invention, in a section along a plane passing through the axis of the loudspeaker.

DETAILED DESCRIPTION OF THE INVENTION

With reference to FIG. 1, an acoustic chamber 1 according to the invention is described.

The acoustic chamber 1 comprises a box 5, and at least one loudspeaker 10 positioned in the box.

The loudspeaker 10 comprises a chassis 15, attached on the box 5, a magnetic circuit 20 secured to the chassis and defining an air gap 25, and a movable assembly 30 relatively to the chassis 15 along an axis D.

The loudspeaker 10 is for example a bass loudspeaker, i.e. a loudspeaker adapted for broadcasting sound waves with frequencies of less than 1,000 Hz, preferentially less than 500 Hz, still more preferentially less than 150 Hz.

The loudspeaker 10 is advantageously substantially axisymmetrical around the axis D.

The loudspeaker 1 also comprises a first suspension joint 35 of the assembly 30 connecting the assembly 30 and the chassis 15, and a second joint 40 for suspension of the assembly 30 connecting the assembly 30 and the chassis 15.

The chassis 15 is sometimes called <<a salad bowl>>. The chassis 15 comprises a wall 45 forming a bottom of the loudspeaker 10, and a side wall 47 connecting the bottom to the box 5.

The chassis 15 is for example in metal.

The side wall 47 exhibits a frusto-conical shape with an axis D flared towards the front of the loudspeaker 10, i.e. the outside of the acoustic chamber 1.

The magnetic circuit 20 is attached on the wall 45 of the chassis 15.

The magnetic circuit 20 for example comprises a permanent magnet 49 of a ring shape, and a ferromagnetic portion 51 adapted for defining the air gap 25.

The assembly 30 comprises a convex diaphragm 53, the convexity of which is turned towards the outside of the loudspeaker 10, a coil-holder 55, a coil 57 for energizing the diaphragm, and a connecting member 59 secured to the diaphragm.

The assembly 30 is translationally movable along the axis D with respect to the chassis 15. The assembly 30 is suspended to the chassis 15 through the first joint 35 and the second joint 40.

The diaphragm 53 is for example a metal diaphragm, and advantageously has a spherical cap shape.

In the whole of the present application, <<axial>> or <<axially>> means <<along the direction materialized by the axis D>>. <<Radial>> or <<radially>> means <<according to a direction substantially perpendicular to the axis D and passing through the axis D>>.

The diaphragm 53 includes a central portion 61 located in proximity to the axis D on which is attached the coil-holder 55, and a peripheral portion 63 radially extending between the central portion and a peripheral edge 65 of the diaphragm.

The peripheral edge 65 in the illustrated example is of a substantially circular shape centered on the axis D.

The coil 57 is able to oscillate along the axis D between an equilibrium position illustrated in FIG. 1, in which it is located in the air gap 25.

In the illustrated example, the connecting member 59 is attached on the peripheral portion 63 of the diaphragm 53, advantageously on the peripheral edge 65.

According to an alternative not shown, the connecting member 59 is attached on the coil-holder 55. According to a particular embodiment, this alternative not shown and the one illustrated in FIG. 1 are combined together.

In the illustrated example, the connecting member 59 and the coil-holder 55 are distinct, i.e. the connecting member is not attached on the coil-holder.

The connecting member 59 includes a proximal portion 67 axially with respect to the diaphragm 53, and a distal portion 69 axially with respect to the diaphragm.

The connecting member 59 is for example in aluminium, in magnesium, or in a composite of plastic material. The connecting member 59 has an advantageous stiffness/density ratio, for example greater than 10 $MPa \cdot kg^{-1} \cdot m^3$.

The connecting member 59 is advantageously open-worked.

The connecting member 59 has a general shape which axially converges in the direction from the diaphragm 53 to the magnetic circuit 20. More specifically, the connecting member 59 converges towards the magnetic circuit 20, advantageously substantially towards a point A located between the magnetic circuit 20 and the wall 45 of the chassis 15, on the radially outer side of the magnetic circuit.

The proximal portion 67 of the connecting member 59 for example has, in a section along a plane P passing through the axis D, an <<L>> shape. The proximal portion 67 for example comprises a skirt 71 substantially cylindrical of axis D, and a rim 73 protruding from the skirt 67 towards the axis D and advantageously substantially perpendicular to the D axis.

The distal portion 69 for example has a substantially frusto-conical shape of axis D. The distal portion 69 is attached on a radially inner edge 75 of the rim 73.

The first joint 35 extends around the axis D, for example substantially in a plane P1 perpendicular to the axis D. The joint 35 advantageously has, in a section along the plane P, a half-roll shape or an Ω (omega) shape, the convexity of the half-roll being for example turned axially towards the rear of the loudspeaker 10, i.e. towards the inside of the acoustic chamber 1.

The first joint 35 is for example in a flexible plastic material. The first joint 35 is advantageously impervious to air.

The first joint 35 includes a radially inner attachment point 77 attached on the connecting member 59, and a second radially outer attachment point 79 attached on the chassis 15, for example on an end of the wall 47 axially located on the front side of the loudspeaker 10.

The attachment points 77 and 79 are for example substantially aligned along the plane P1.

The attachment point 77 is axially located away from the peripheral edge 65 of the diaphragm 53, for example at a distance D1 comprised between the length of the peripheral edge 65 of the loudspeaker 10 divided by 200 and the length of the peripheral edge 65 of the loudspeaker 10 divided by 10.

Advantageously, the connecting point 77 is closer to the axis D than the peripheral edge 65, for example by a distance D2 comprised between zero and the radius of the loudspeaker divided by 4.

In the illustrated example, the attachment point 77 is located on the rim 73 of the proximal portion 67 of the connecting member 59.

D1 also illustrates in the illustrated example, the axial extension of the proximal portion 67 of the connecting member 59.

The second joint 40 is axially further away from the diaphragm 53 than the first joint 35. For example, the second joint 40 is located at a distance D3 from the first joint along the D axis, with D3 advantageously comprised between 0.5 and 10 times the possible peak-to-peak axial maximum displacement of the diaphragm 53.

The second joint 40 extends around the axis D, for example substantially in a plane P2 perpendicular to the D axis.

The second joint 40 is for example a joint with bellows known per se to one skilled in the art.

The second joint 40 comprises a radially inner attachment point 81 located on the connecting member 59, and an attachment point 83 located on the chassis 15, for example in proximity to the junction between the walls 45 and 47.

The attachment points 81 and 83 are for example substantially aligned along the plane P2.

The attachment point 81 is advantageously located on an end 85 of the connecting member 59 axially opposite to the diaphragm 53.

The planes P1 and P2 define between them a portion 87 of the space in which is located the coil 57 in its rest position. The planes P1 and P2 also define a middle plane P' located at equal distances from the plane P1 and from the plane P2.

The middle plane P' and the plane P1 define between each other a portion 89 of the space in which is advantageously located the coil 57 in its rest position.

The box 5 comprises an external wall 91 extending around the D axis in the extension of the diaphragm 53 when the coil 57 is in its rest position.

The wall 91 is for example in plastic material. The wall 91 advantageously, as seen from the outside of the chamber 1, has a general shape of a spherical portion.

The wall 91 comprises a portion 93 axially extending between the chassis 15 and the diaphragm 53 and adapted for partly concealing the first joint 35 from the view of the user of the acoustic chamber 1.

The operation and the advantages of the acoustic chamber 1 will now be described.

When a variable current flows through the coil 57, it vibrates in the air gap 25 along the D axis. Thus, the assembly 30 is set into motion. The diaphragm 53 vibrates and then emits sound waves.

The first joint 35 and the second joint 40 ensure a mechanical suspension of the assembly 30.

By means of the connecting member 59, the second joint 40 is attached on the assembly 30 by its radially inner attachment point 81. This gives the possibility of limiting the radial extension E of the chassis 15 on the rear side of the loudspeaker 10 (i.e. on the side axially opposite to the diaphragm 53). Thus, the loudspeaker 10 is laid out more easily in the acoustic chamber 1 of a general substantially spherical shape in the vicinity of the diaphragm 53.

Further, this frees space for at least laying out another loudspeaker (not shown) in regions P3 and P4 of the acoustic chamber 1.

Advantageously, by means of the connecting member 59, it is possible to accommodate the first joint 35 inside the convex shape, in the example locally spherical, formed by the diaphragm 53 and the box 5. Indeed, as the radially inner attachment point 77 is found at a distance D1 from the peripheral edge 65, and not on the peripheral edge or in the close vicinity of the peripheral edge, the first joint 35 does not radially jut out of said convex shape.

Further, it is thus possible to extend the box 5 as far as the peripheral edge 65 of the diaphragm 53 with the wall 91, which gives the possibility of concealing the first joint 35.

Also advantageously, by means of the connecting member 59, the attachment point 77 is located radially at the distance D2 from the peripheral edge 65. The result of this is that it is easier to accommodate the first joint 35 radially between the assembly 30 and the chassis 15.

The invention claimed is:

1. An electrodynamic loudspeaker including:

a chassis, at least one magnetic circuit secured to the chassis and defining at least one air gap, at least one movable assembly relatively to the chassis, the assembly including a convex diaphragm, the convexity of which is turned towards the outside of the loudspeaker, and at least one coil for exciting the diaphragm, the coil being located in the air gap and defining an axis of the loudspeaker, a first joint for suspending the assembly connecting the assembly and the chassis, and a second joint for suspending the assembly, the second joint being axially further away from the diaphragm than the first joint, wherein the assembly further comprises at least one connecting member secured to the diaphragm, the second joint including a radially inner attachment point attached on the connecting member, and a radially outer attachment point attached on the chassis, and wherein the assembly further comprises a coil-holder attached on a central portion of the diaphragm, the connecting member being distinct from the coil-holder and attached on a peripheral portion of the diaphragm, and wherein the first joint includes a radially inner attachment point attached on the connecting member, the connecting member having a shape so that said radially inner attachment point of the first joint is axially located away from the peripheral edge of the diaphragm.

2. The loudspeaker according to claim 1, wherein the coil occupies at rest a rest position axially located between a first radial plane in which the first joint substantially extends, and a second radial plane in which the second joint substantially extends.

3. The loudspeaker according to claim 2, wherein the rest position of the coil is axially located between the first radial plane and a middle plane located at an equal distance from the first plane and from the second plane.

4. The loudspeaker according to claim 1, wherein the connecting member has a general shape which axially converges in the direction from the diaphragm to the magnetic circuit.

5. The loudspeaker according to claim 1, wherein said shape of the connecting member is such that said radially inner attachment point of the first joint is substantially closer to the axis than the peripheral edge of the diaphragm.

6. The loudspeaker according to claim 1, wherein the connecting member includes an axially proximal portion with respect to the diaphragm, and an axially distal portion with respect to the diaphragm, the radially inner attachment point of the second joint being substantially located along the axis on an end of the distal portion, the end being opposite to the proximal portion along the axis.

7. The loudspeaker according to claim 1, wherein the connecting member is openworked.

8. An acoustic chamber including at least one loudspeaker as defined by claim 1.

9. The loudspeaker according to claim 1, wherein the connecting member is attached on a peripheral edge of the diaphragm.

* * * * *